United States Patent [19]

Knoblauch et al.

[11] 4,373,692

[45] Feb. 15, 1983

[54] CHAIR CONTROL WITH HEIGHT ADJUSTMENT ACTUATOR

[75] Inventors: Jack R. Knoblauch, Byron Center; Duane M. Beukema, Grand Rapids; Kenneth W. Hozeski, Grandville, all of Mich.

[73] Assignee: Steelcase Inc., Grand Rapids, Mich.

[21] Appl. No.: 145,623

[22] Filed: May 1, 1980

[51] Int. Cl.[3] ..... F16M 11/00

[52] U.S. Cl. ..... 248/162.1; 297/347

[58] Field of Search ..... 248/162.1, 576, 577, 248/578, 579; 297/326, 330, 339, 347, 71

[56] References Cited

U.S. PATENT DOCUMENTS

| | | | |
|---|---|---|---|
| 2,367,829 | 1/1945 | Shinn | 297/347 X |
| 2,641,306 | 6/1953 | Lerman | 297/347 X |
| 2,710,047 | 6/1955 | Duppstadt | 297/347 X |
| 2,849,051 | 8/1948 | Streeter | 297/347 X |
| 4,013,257 | 3/1977 | Paquette | 297/576 |

FOREIGN PATENT DOCUMENTS

| | | | |
|---|---|---|---|
| 2263795 | 7/1973 | Fed. Rep. of Germany | 297/71 |

*Primary Examiner*—Wayne L. Shedd

*Attorney, Agent, or Firm*—Price, Heneveld, Huizenga & Cooper

[57] ABSTRACT

The specification discloses a chair control in which a chair height adjustment actuator includes a handle whose position does not change relative to the tilting member of the chair control. The handle is pivotally mounted to the tiltable member and engages the end of a linkage rod pivotally mounted to the handle. The other end of the linkage rod is pivotally joined to an actuator arm which in turn is pivotally secured to the mounting member of the stationary chair control housing adjacent that point at which the mounting member is secured to a chair base of the type having a height adjustment actuator located at the top of the chair base column.

26 Claims, 12 Drawing Figures

CHAIR CONTROL WITH HEIGHT ADJUSTMENT ACTUATOR

BACKGROUND OF THE INVENTION

The present invention relates to chair controls. In essence, it also relates to chair height adjusting mechanisms. Indeed, the present invention creates a unique marriage between the two.

Chair controls are mounted underneath a chair seat and in the broadest sense are used to secure the chair seat to a pedestal base. Usually, they are utilized to control the rearward tilting of a chair, although in the broadest sense for purposes of this invention, the term chair control is intended to include a non tilting unit. They typically comprise a stationary housing having mounting means for mounting the stationary housing to the top of a chair base. A tilting member is then pivotally connected to the stationary member and the chair seat, or back, or both are then secured to the tilting member. Some type of resilient biasing means is operably positioned between the tilting member and the stationary housing whereby rearward tilting of the chair is "controlled".

Chair height adjusting mechanisms are part of the pedestal chair base. There is usually some means in the central column of the pedestal base which facilitates adjusting the column upwardly or downwardly, thereby adjusting the height of the chair to which the chair base is mounted. It is to the top of the central column that the chair control is typically mounted. Usually adjusting the height of the column involves manipulating a button or separate column sleeves or the like, located on the column itself, to adjust the column upwardly or downwardly. Often, one has to reach underneath the chair base and underneath the column to manipulate the height adjusting actuator.

Pneumatic cylinders are becoming popular chair height adjustment mechanisms. Such a cylinder is located within a central telescoping column. The cylinder includes an actuator button which when depressed, causes the cylinder to expand if the chair is empty or to contract if the chair is occupied. Thus, height adjustment upwardly or downwardly is achieved.

Usually, there is a lever mounted on the chair base in such a way that when it is deflected one way or another, it actuates the pneumatic cylinder actuator button. The problem with such an arrangement is that in chairs in which the chair seat can be tilted through the action of a chair control, the position of the end of the lever varies relative to the chair user. He always has to look for the end of the lever. This is true whether the lever is mounted directly to the base as is typical, or to the stationary member of the chair tilter control.

SUMMARY OF THE INVENTION

The present invention is the result of a marriage between a chair control and that which is normally considered part of a chair height adjustment mechanism. In the chair control of the present invention, linkage means are pivotally mounted at one end adjacent the mounting means to which a chair base having a height adjustment actuator is normally secured. The linkage is then pivotally connected at its other end to the tiltable member of the chair control and it extends to the exterior of said tiltable member. Handle means are operably connected to the extending end portion of said linkage means whereby by engaging said handle, one operates the linkage means which in turn acts on the actuator at the top of a chair base when the chair control is mounted to the chair base. As a result, the end of the linkage means travels with the tiltable member when it tilts and is hence always generally in the same spot relative to a user sitting in the chair and leaning back in the chair. Thus the linkage means and handle assembly is more than just a lever mounted on the chair control, it is an operator control point which tends to tilt when the chair tilts, thereby remaining generally stationary with respect to a user seated in the chair.

These and other objects, advantages and features of the invention will be more readily understood and appreciated by reference to the written specification and appended drawings.

DESCRIPTION OF THE PREFERRED EMBODIMENT

Figure 1:
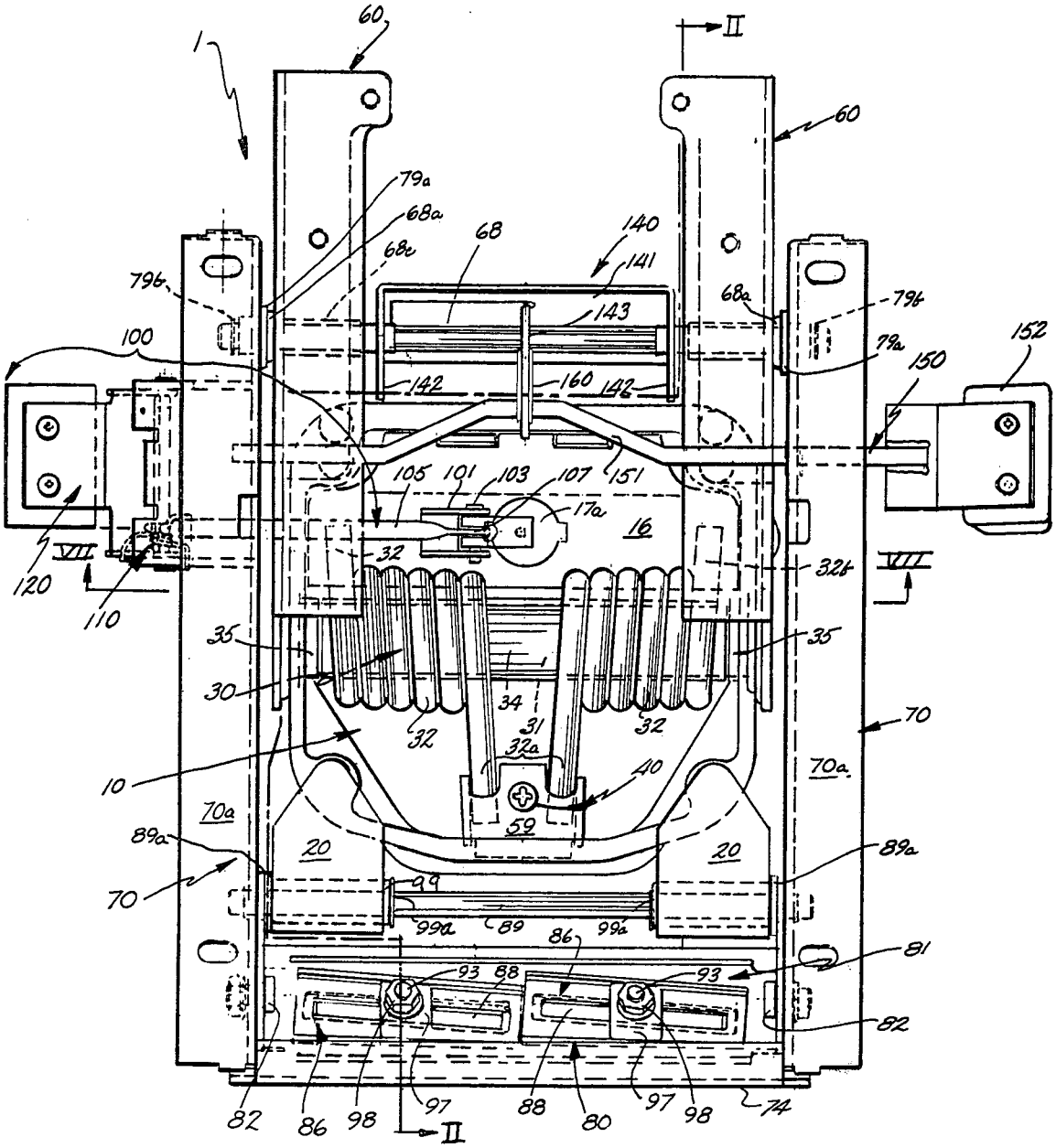
FIG. 1 is a plan view of a chair control made in accordance with the present invention.

Chair control 1 includes a pneumatic cylinder actuator assembly 100 for actuating the pneumatic cylinder 3 located with the column assembly 2 of a supporting chair base (FIGS. 1–4).

A pneumatic cylinder 3 is housed within a hollow sleeve 2. At the top end of pneumatic cylinder 3 is an actuator button 3*a*. When one depresses actuator button 3*a* through use of actuator assembly 100, one allows the piston rod to expand outwardly with respect to its cylinders; or alternatively if weight is applied to the chair upon which control 1 is mounted, one compresses the piston rod into the cylinder 3.

Figure 4:
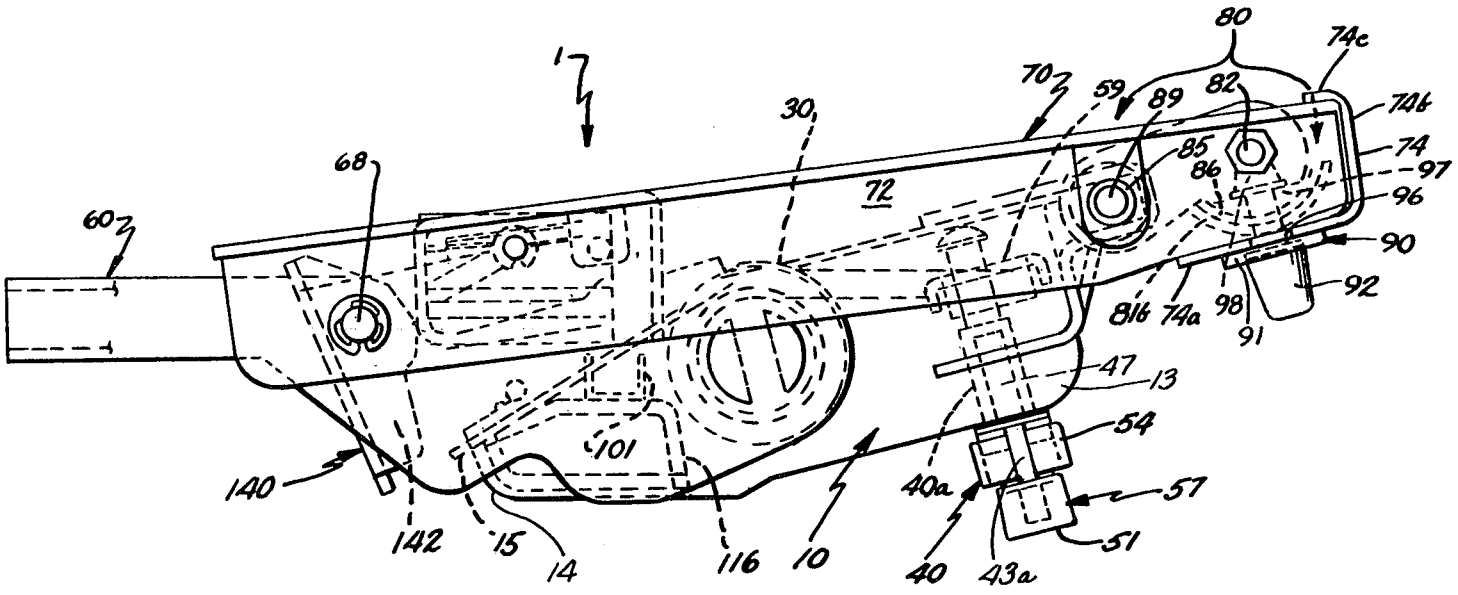
FIG. 4 is a side elevational view of the chair control with some of the internal components being shown in hidden lines.

Chair control 1 comprises a stationary control housing 10 which houses a bias means 30 (FIGS. 1 and 4). The degree of pretension of bias means 30 is controlled by tension bolt assembly 40. Chair back support arms 60 are secured to the ends of the arbor 31 of bias means 30 and pivot with respect to stationary control housing 10. Chair seat support stretcher assembly 70 is pivotally mounted at its rear directly to back support arms 60. The front of seat support assembly 70 is slidably mounted within tracks 20 on the front of stationary control housing 10. This slidable mount could be direct, but as shown is through a seat adjustment assembly 80 which is not described in detail herein since it does not form a part of this invention.

Chair control 1 is of the "synchrotilt" type where the back and seat both tilt, but at different rates. In the broader aspects of the present invention, it would not have to be so. It is significant only that there be a tiltable member and a stationary member. Other features of chair control 1 which are shown in the drawings are not critical to this invention and hence are not described in detail herein.

Figure 2:
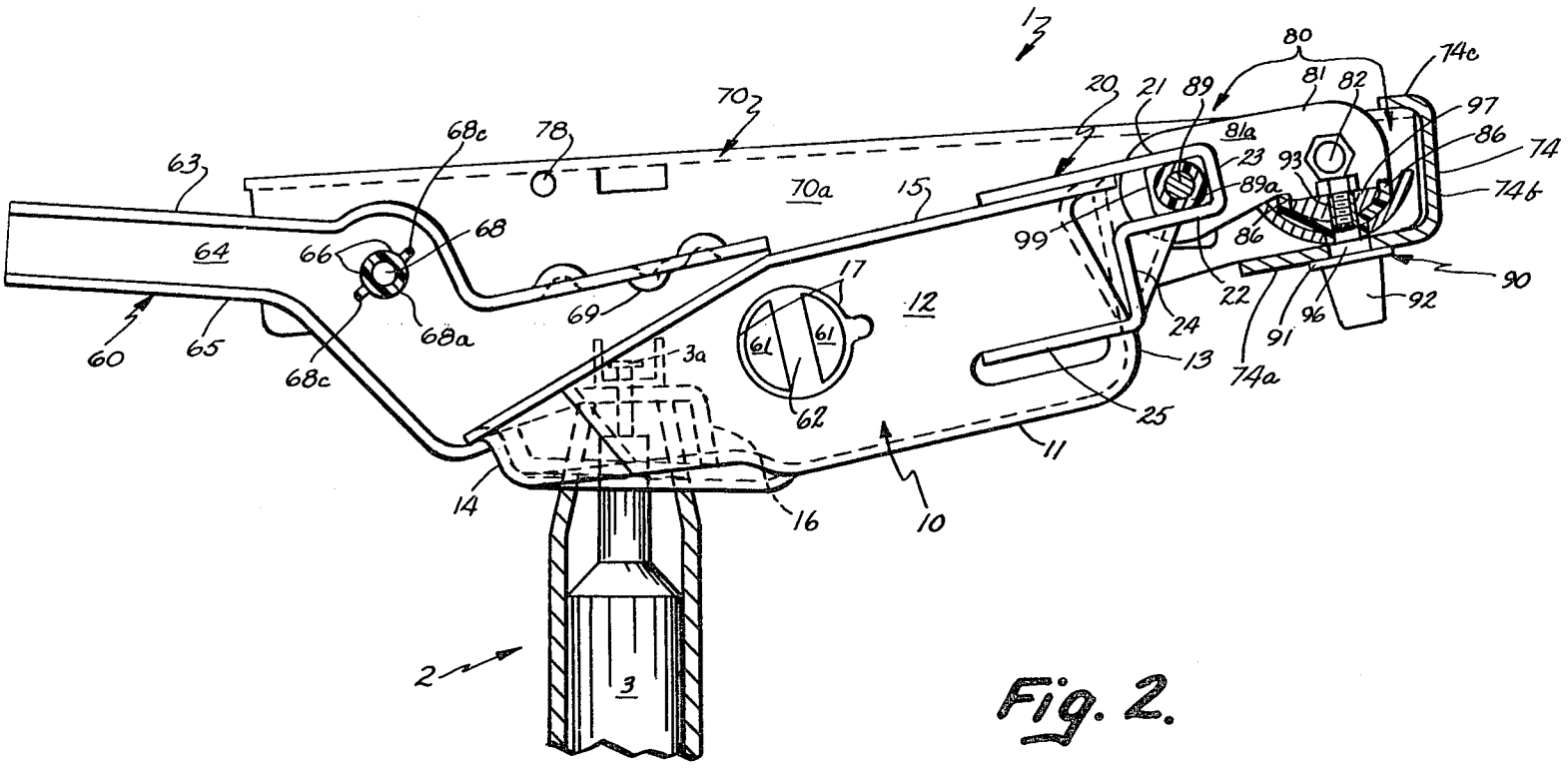
FIG. 2 is a fragmentary cross sectional view taken generally along planes II—II of FIG. 1, showing only the right side seat support stretcher and back support arm (as viewed in FIG. 1) and eliminating the bias means 30, the tension bolt assembly 40, the pneumatic cylinder adjustment assembly 100, 110, 120 and 130, and eliminating the back upright lock assembly 140, 150 and 160.
Figure 3:
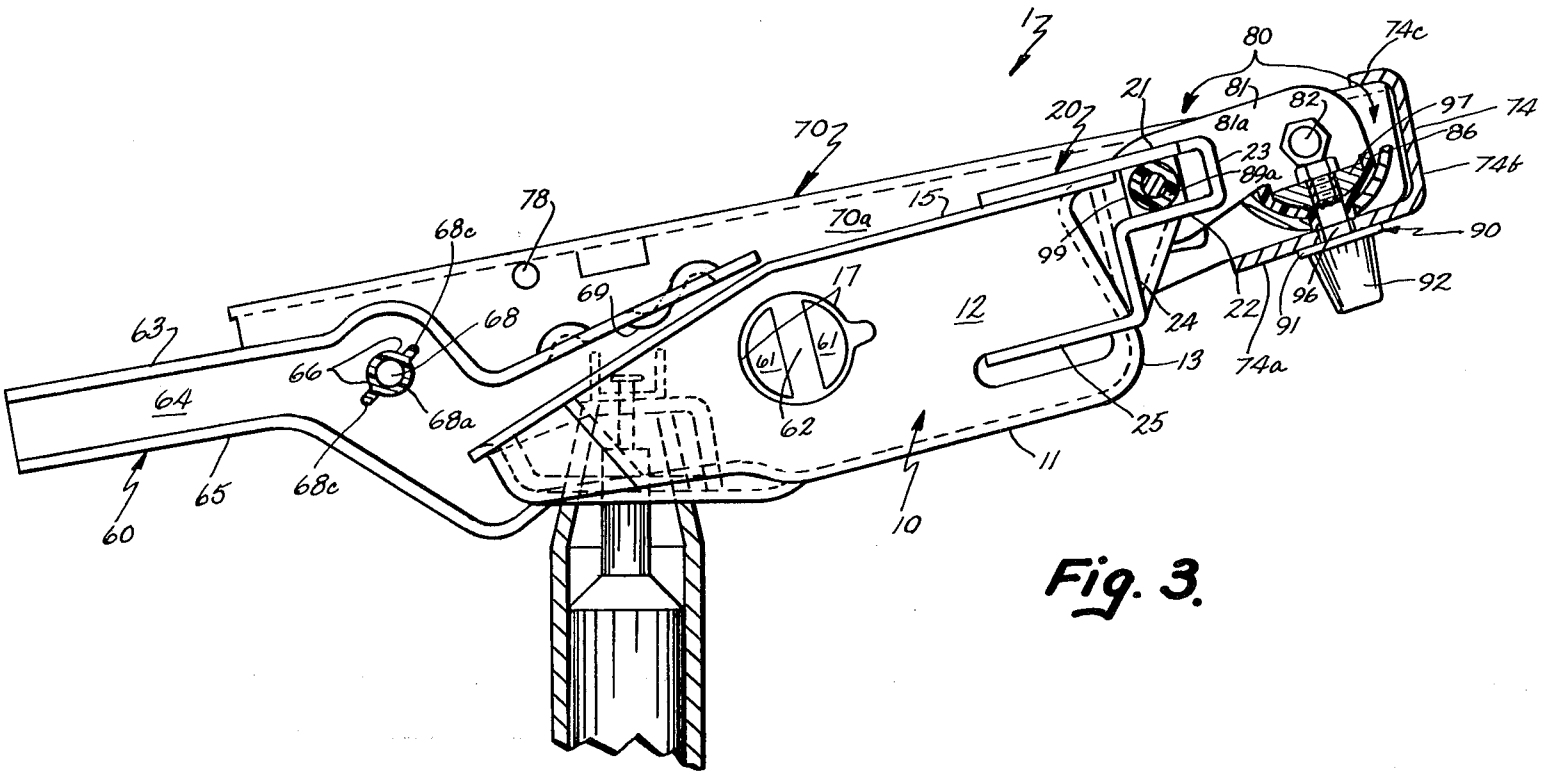
FIG. 3 is the same view as FIG. 2, but with the chair control in the position which it assumes when a person leans back in a chair to which the chair control is attached.

Stationary control housing 10 is a stamped or otherwise formed metal dish having a bottom wall 11, side walls 12, a front wall 13 and rear wall 14 (FIGS. 2 and 3). A lip 15 extends around the upper periphery (see FIG. 2). There is an aperture in bottom 11 through which the upper end of spindle 2 extends. A spindle mounting plate 16 is welded to the inside of housing 10 and includes an aperture 17*a* therein to also receive the upper end of spindle assembly 2 (FIGS. 1 and 2).

Bias means 30 comprises a torsional coil spring arrangement. An arbor 31 which is generally circular in cross sectional configuration extends through holes 17 in side walls 12 of stationary control housing 10 (compare to FIGS. 1 and 2). Arbor 31 is actually hidden in FIG. 1 since it is covered by a plastic sleeve 34. The ends of arbor 31 are rotatably carried in end bearings 35 which are located within side wall holes 17. Coiled around arbor 31 and sleeve 34 are a pair of coil springs 32. The front ends 32*a* of coil springs 32 are captured under retainer nut 59 of tension bolt assembly 40, captured in notches and between the side walls thereof. The rear ends 32*b* of springs 32 are captured under the chair back support arms 60. Tension adjustment is achieved by tightening or loosening tension bolt 40 in retainer nut 59. Basically, tension adjustment bolt assembly 40 comprises a bolt 40*a* having a hollow shank normally housing a lever 47. One can grasp gripping cap 51, retract lever 47, pivot it to one side into a slot 43*a* and rotate it to thread bolt 40*a* up or down in retainer 59.

Chair back support arms 60 are formed of metal and are preferably channel shaped in cross section having a top wall 63, a side wall 64 and a bottom wall 65 (FIG. 2). There are two such chair back mounting arms 60, one located on either side of stationary housing 10 (FIG. 1). The generally channel shape cross section allows one to slip a chair back support frame or arm into the channels.

The arbor mounting hole or holes 61 in the side wall 64 of chair back support arm 60 is visible through the hole 17 in the side of stationary housing 10 in FIG. 2. There are two semi-circles 61 spaced by a bridge 62. The ends of arbor 30 are slotted so that they fit into the semi-circles 61. In this way, chair back support arms 60 are fixed against rotation with respect to arbor 30 and as one tilts back in the chair, chair back support arms 60 pivot and arbor 30 rotates within its plastic end bearings 35.

On top wall 63 of each support arm 60, located toward the front thereof are a pair of downwardly projecting dimples or protrusions 69 (FIG. 2). The rear end 32*b* of each coil spring 30 is captured between dimples 69. The other protrusions shown projecting up from top wall 63 are merely reinforcing ribs.

Located about midway along the length of each chair back support arm 60 is a hole 66 which is adapted to receive the rear axle 68 and suitable bearing 68*a*. It is on the rear axle 68 that the rear of chair seat support assembly 70 is pivotally carried.

The chair seat support assembly 70 comprises a pair of spaced stretchers 70*a* joined at the front by front piece 74 (FIGS. 1, 2, 5 and 6). Each side stretcher 70*a* is formed of steel to define a top ledge 71 and a side wall 72. There are mounting holes 76 in top ledges 71 to facilitate mounting chair control 1 to the bottom of a chair seat. Located in one side stretcher 70*a* is a push rod hole 77 through which the push rod 105 of pneumatic cylinder adjustment assembly 100 extends. There is an aperture 78*a* in the same side stretcher and a similar aperture 78 in the other side stretcher 70*a* through which the chair control lock actuator rod 150 extends.

Located towards the rear of each side wall 72 of each stretcher 70*a* is a rear axle receiving hole 79 (FIG. 6) which receives the end of rear axle 68 carried in a suitable plastic bearing of "T" shaped longitudinal cross section 79*a* (FIG. 1). Of course, suitable retainer clips 79*b* or the like then hold rear axle 68 in position (hidden in FIG. 1).

Figure 7:
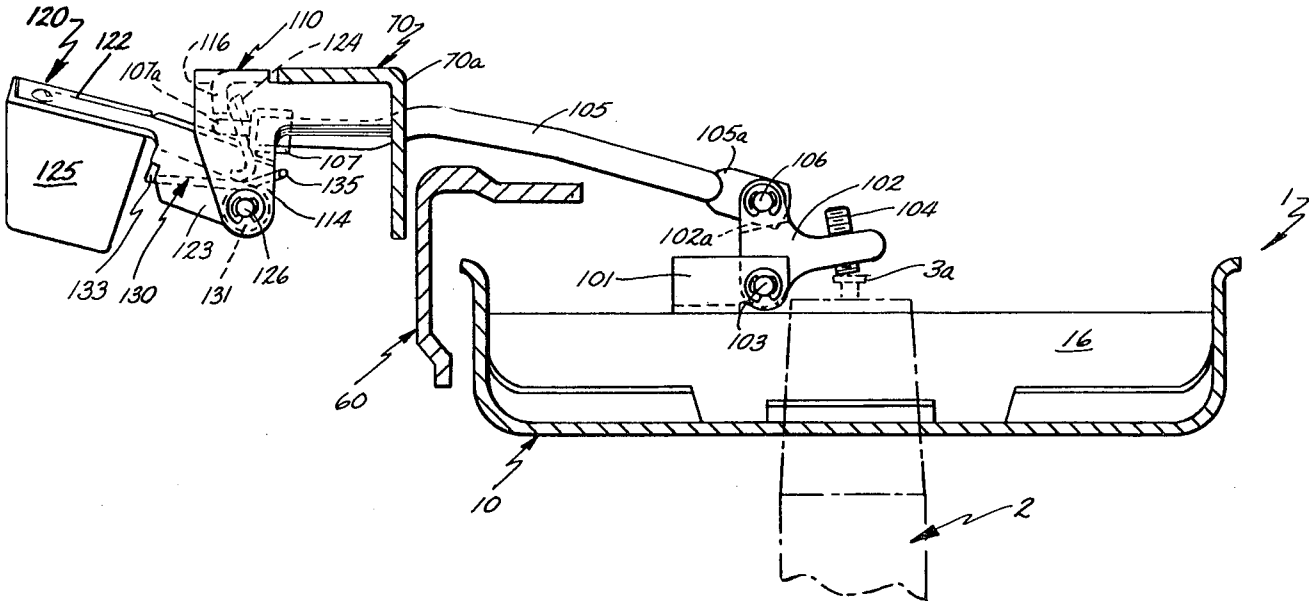
FIG. 7 is a fragmentary cross-sectional view taken generally along plane VII—VII of FIG. 1, but showing only as much as the chair control as necessary to illustrate the pneumatic cylinder actuator assembly 100.

FIG. 7 provides the best illustration of pneumatic cylinder actuator assembly 100. A pivot mounting bracket 101 is welded to and is part of stationary housing 10. Specifically, it is welded on top of spindle mounting plate 16 (see also FIGS. 1 and 2). Pivot mounting bracket 101 has a pair of upwardly projecting spaced legs, each with an aperture therein to receive a pivot pin 103. Pivot pin 103 extends through a "T" shaped pivot arm 102. Thus pivot arm 102 is free to pivot about pivot 103. It is seated between the spaced legs of pivot mounting bracket 101.

Located in the extending leg of pivot arm 102 is an adjustment screw 104. Adjustment screw 104 rests on top of cylinder actuator button 3*a*.

Pivotally connected to the opposite end of the "T" cross bar of arm 102 is push rod 105. The upper end of arm 102 is grooved or notched at 102*a* (note the hidden lines in FIG. 15) and the flattened end 105*a* push rod 105 fits down into slot or groove 102*a*. A top pivot pin 106 extends through holes in arm 102 and in the end 105*a* of push rod 105 to pivotally join the two together. Suitable retainers or clips hold pivot pins 103 and 106 in place. This interconnection is loose, allowing push rod 105 to shift slightly fore and aft of housing 10, as well as to pivot up and down.

Figure 5:
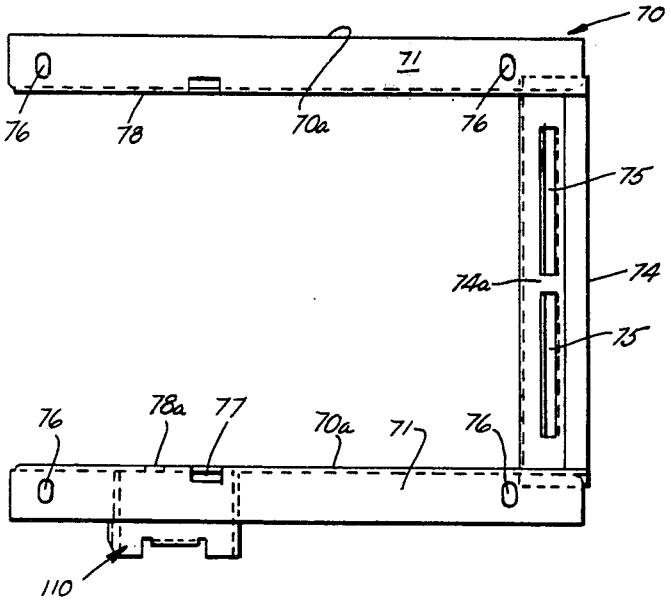
FIG. 5 is a top plan view of the chair seat supporting assembly 70.
Figure 6:
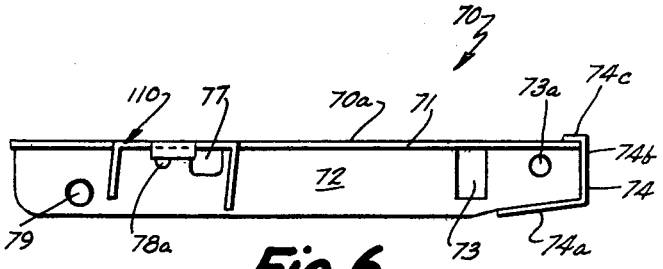
FIG. 6 is a side elevational view thereof.

Push rod 105 extends outwardly through side hole 77 in side stretcher 70*a* (see also FIG. 5). It will be noted that seat support 70 is located above back support 60 in elevation, in part so that push rod 105 will extend out over one back support 60 without interfering with it (FIGS. 2–4). Indeed, back support arm 60 deviates downwardly after it goes over pivot axel 68 and then slopes back upwardly towards the front of control 1 so as to create a depression in the vicinity of push rod 105 (and of control lock actuator 150 which is not pertinent to this invention), thereby insuring an absence of interference even when control 1 is tilted.

Figure 12:
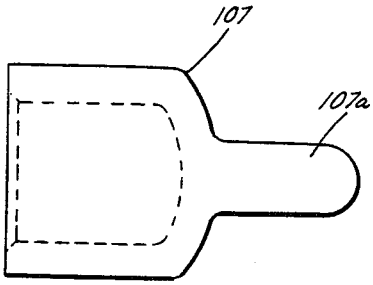
FIG. 12 is an elevational view of the push rod end cap 107.

Fitted over the projecting end of push rod 105 is a plastic end cap 107 having a projecting tip 107*a* (see also FIG. 12). Cap 107 is hollowed out as indicated by the hidden lines in FIG. 20 to receive the end of push rod 105. It is apparent that when one pushes on push rod 105, one causes arm 102 to rock downwardly and push button 3*a* downwardly, thereby actuating pneumatic cylinder 3.

Figure 8:
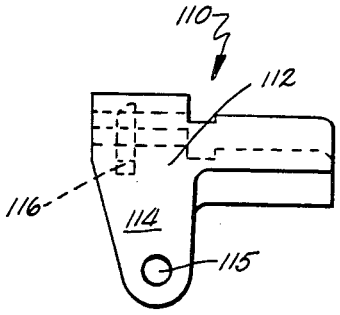
FIG. 8 is a side elevational view of the operator handle mounting bracket 110 for the pneumatic cylinder adjustment assembly 100.
Figure 9:
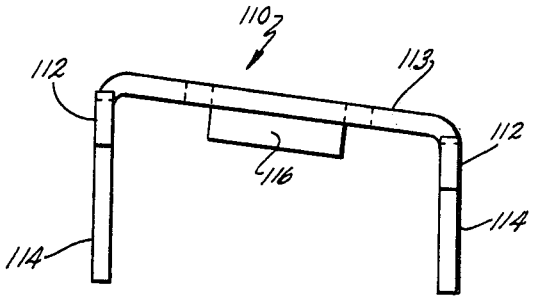
FIG. 9 is a rear elevational view thereof (right side as viewed in FIG. 16)

The pushing of push rod 105 is achieved through operator handle 120. Operator handle 120 is pivotally mounted on a handle mounting bracket 110 which in turn is welded to stretcher 70*a* (see FIGS. 1, 5 and 7). Referring to FIGS. 8 and 9, it will be seen that handle mounting bracket 110 comprises a pair of spaced side walls 112 joined by a top wall 113. Depending downwardly from the left hand (as viewed in FIG. 8) portion of mounting bracket 110 are a pair of spaced legs 114. They include apertures 115 therein to facilitate pivotal mounting of handle 120.

Figure 10:
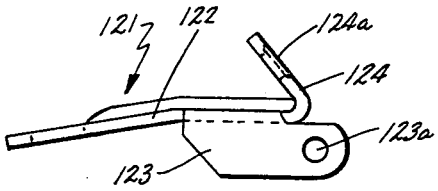
FIG. 10 is a side elevational view of the handle bracket 121.

Handle 120 comprises first of all a handle bracket 121 formed of metal, as is mounting bracket 110 (FIG. 10). Handle bracket 121 includes a top plate 122, ribbed for reinforcement and a pair of spaced, downwardly depending apertured ears 123 on either side of top plate 122. These ears 123 fit just inside the spaced legs 114 of mounting bracket 110 and a pivot pin 126 extends through apertures 123*a* and apertures 115 to hereby pivotally mount handle bracket 121 to mounting bracket 110 (FIG. 7). Suitable retainer clips hold pin 126 in place.

Projecting upwardly from top plate 122, and sloped somewhat rearwardly with respect thereto, is push plate flange 124 (FIG. 10). It includes an aperture 124*a* therein (indicated by hidden lines in FIG. 10). The projecting tip 107*a* on the end of push rod 105 projects into and through aperture 124*a* in push plate flange 124 (FIG. 7). Thus when one pushes upwardly on the handle 120, push plate flange 124 pushes push rod 105 inwardly, thereby pivoting arm 102 downwardly and depressing cylinder button 3*a*.

To facilitate pushing handle 120, an enlarged plastic button 125 is secured to the exposed under portion of top plate 122 of handle bracket 121. It will be noted that handle mounting bracket 110 includes a downwardly turned stop flange 116 along the front edge (or left edge as viewed in FIG. 7 or 8) of top plate 113 (FIGS. 8 and 9). This flange 116 serves as a stop for push plate flange 124 and thereby prevents handle 120 from falling off the tipped end 107*a* of push rod 105 (see FIG. 7).

Figure 11:
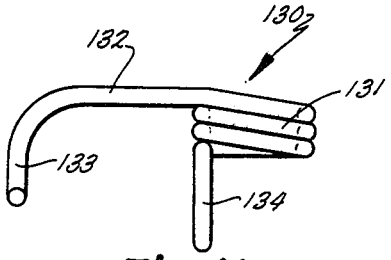
FIG. 11 is a top plan view of the handle spring 130.

Additionally, handle 120 is biased upwardly so that there is always a slight pressure against push rod 105 by means of a small spring 130 (FIGS. 7 and 11). Spring 130 is capable of biasing handle 120 against push rod 105 only with sufficient force to generate approximately 1 or 2 pounds of force on the top of cylinder button 3*a*. It takes a force of approximately 30 pounds on button 3*a* to actuate cylinder 3. Thus, the only purpose of spring 130 is to insure that handle 120 is held snuggly against the end of push rod 105 at all times.

Spring 130 comprises a coil portion 131 with a long leg 132 extending off one end of coil 131 and a short leg 134 extending off the other end (FIG. 11). The end of long leg 132 is bent laterally at 133 and the end of short leg 134 is bent downwardly as viewed in FIG. 11 such that the bent end is not visible in FIG. 11. However in FIG. 7, it can be seen that coil 131 of spring 130 extends around pivot pin 126 and that the bent end 135 of short leg 134 wraps around the back edge of the downwardly depending leg 114 of handle mounting bracket 110. The bent end 133 of long leg 132 then wraps around the leading edge of handle 120, thereby biasing it upwardly and holding it snuggly against plastic cap 107 on the end of push rod 105.

Thus, handle 120 is pivotally mounted to seat support 70 rather than to stationary housing 10. This insures that with respect to a user in the chair seat, handle 120 will always be in the same relative location, even if seat support 70 is tilted somewhat by the user. The loose connection of the tipped end 107 of push rod 105 to push plate 124 of handle 120, and to a lesser extent the loose fit at the other end of rod 105, insures that push rod 105 won't bind up when seat support 70 is tilted.

OPERATION

With the various assemblies, sub assemblies and components thus described, the operation of chair control 1 can be more fully appreciated. As a person leans back in a chair to which chair control 1 is assembled, the chair back support arms 60 begin to pivot about their pivotal mounting (on arbor 31) to stationary housing 10. At the same time the rear of seat support stretcher assembly 70 begins to shift downwardly relative to its front since chair seat support stretcher assembly 70 is pivotally joined to back support arms 60 by rear axle 68. The front of seat support assembly 70 pivots about front axle 89 which, along with its bushings 99, slides rearwardly in tracks 20. FIGS. 2 and 3 illustrate chair control 1 in its untilted and fully tilted conditions respectively.

If one wishes to change the height of the chair, one can reach under the chair seat and press upwardly on handle 120. This pivots handle 120 about mounting bracket 110 and causes push plate flange 124 to push against the end of push rod 105. This in turn pivots arm 102 downwardly and thereby pushes cylinder button 3*a* downwardly (FIG. 7). If the chair is unoccupied when one does this, pneumatic cylinder 3 will expand, thereby causing the chair to move upwardly. If one is seated on the chair when one does this, pneumatic cylinder 3 will contract, thereby adjusting the chair height downwardly.

Of course, it is understood that the above is merely a preferred embodiment of the invention and that various changes and alterations can be made without departing from the spirit and broader aspects thereof as more particularly defined in the appended claims.

The embodiments of the invention in which an exclusive property or privilege is claimed are defined as follows:

1. In a chair control having a stationary member for mounting on a height adjustable chair base, which base has a height adjustment actuator at the top thereof, said stationary member having mounting means for securing to the top of said chair base, and said chair control having a tiltable member pivotally mounted relative to said stationary member for securing to a chair seat, the improvement comprising: linkage means pivotally mounted at one end adjacent said mounting means whereby when said chair control is located in place atop a chair base, the height adjustment actuator of said chair base is engaged by said linkage means; said linkage means being pivotally connected at its other end to said tilting member of said chair control and extending to the exterior of said tilting member; handle means operably connected to said extending end of said linkage means whereby a user seated in a chair to which said chair control is secured can readily actuate the height adjustment actuator on a chair base mounted underneath said chair control by reaching under said chair and activating said handle.

2. The chair control of claim 1 in which said handle is pivotally mounted directly on said tilting member whereby its position relative to said tilting member and to a chair seat mounted on said tilting member never changes.

3. The chair control of claim 2 in which said linkage means includes a rod, said handle including a push plate engaging the end of said rod whereby when one pushes on said handle, said push plate pushes said rod.

4. The chair control of claim 3 which includes a tip smaller in cross section than said rod and projecting from the end of said rod; said push plate on said handle including an aperture therein through which said tip projects to thereby hold said rod in position with respect to said push plate.

5. The chair control of claim 4 in which said tip is part of a plastic cap which seats over the end of said rod.

6. The chair control of claim 3, 4, or 5 in which bias means connected to said handle biases said push plate towards engagement with said end of said rod.

7. The chair control of claim 3, 4 or 5 in which said linkage means includes an arm of generally T-shaped configuration, having a cross bar and a stem; one end of said cross bar being pivotally mounted to said mounting means and the other being loosely, pivotally connected to said rod; said stem of said T projecting from said cross bar and over an opening in said mounting means through which the height adjusting actuator of a chair base ends when said chair control is mounted on such a chair base.

8. The chair control of claim 7 in which said stem includes a screw threaded laterally therethrough for pushing against said height adjustment actuator whereby one can adjust the action of said arm against the height adjustment actuator by threading said screw upwardly or downwardly in said stem.

9. The chair control of claim 3, 4 or 5 in which said handle is pivotally mounted to said tiltable member about a pivot axis which extends generally longitudinally with respect to the fore and aft direction of said chair control; said push plate projecting upwardly from said handle whereby as one pushes said handle upwardly towards the bottom of a chair seat mounted on said tiltable member, said push plate is rotated inwardly towards the center of said chair control, thereby pushing said push rod inwardly.

10. The chair control of claim 9 in which bias means connected to said handle biases said push plate towards engagement with said end of said rod.

11. The chair control of claim 10 in which said tiltable member includes a downwardly projecting stop flange which extends into the path of rotation of said push plate on the opposite side of said push plate from said rod whereby said stop flange limits rotation of said push plate and said handle away from the center of said chair control.

12. The chair control of claim 11 in which said tiltable member includes a pair of spaced, downwardly projecting ears, a pivot axle extending between said ears, said handle being pivotally mounted on said pivot axle.

13. The chair control of claim 12 in which said bias means comprises a spring having a looped portion looped around said pivot axle and having a hooked end hooked underneath a portion of said handle and another hooked end hooked behind one of said downwardly projecting ears whereby said handle is biased upwardly against the end of said push rod.

14. The chair control of claim 11 in which said linkage means includes an arm of generally T-shaped configuration, having a cross bar and a stem; one end of said cross bar being pivotally mounted to said mounting means and the other being loosely, pivotally connected to said rod; said stem of said T projecting from said cross bar and over an opening in said mounting means through which the height adjusting actuator of a chair base ends when said chair control is mounted on such a chair base.

15. The chair control of claim 14 in which said stem includes a screw threaded laterally therethrough for pushing against said height adjustment actuator whereby one can adjust the action of said arm against the height adjustment actuator by threading said screw upwardly or downwardly in said stem.

16. The chair control of claim 1 in which said linkage means includes an arm of generally T-shaped configuration, having a cross bar and a stem; one end of said cross bar being pivotally mounted to said mounting means and the other being loosely, pivotally connected to said rod; said stem of said T projecting from said cross bar and over an opening in said mounting means through which the height adjusting actuator of a chair base ends when said chair control is mounted on such a chair base.

17. The chair control of claim 16 in which said stem includes a screw threaded laterally therethrough for pushing against said height adjustment actuator whereby one can adjust the action of said arm against the height adjustment actuator by threading said screw upwardly or downwardly in said stem.

18. In a chair control adapted for mounting on a height adjustable chair base, which base has a height adjustment actuator at the top thereof, said chair control having mounting means for securing to the top of said base, the improvement comprising: an arm of generally T-shaped configuration having a cross bar and a stem, one end of said cross bar being pivotally mounted to said mounting means with said stem of said "T" projecting from said cross bar and over an opening in said mounting means through which the height adjusting actuator of a chair base extends when said chair control is mounted on said chair base; a rod pivotally mounted to the other end of said cross bar and extending through an aperture in the side of said chair control to the exterior thereof; a handle pivotally mounted on said chair control generally adjacent the exteriorly extending end of said rod, said handle including a push plate engaging said exteriorly extending arm of said rod whereby when one pushes on said handle, said push plate pushes said rod which pivots said arm and pivots said stem of said arm downwardly towards a height adjusting actuator on a chair base when said chair control is mounted on such a chair base.

19. The chair control of claim 18 which includes a tip smaller in cross section than said rod and projecting from the end of said rod; said push plate on said handle including an aperture therein through which said tip projects to thereby hold said rod in position with respect to said push plate.

20. The chair control of claim 19 in which said tip is part of a plastic cap which seats over the end of said rod.

21. The chair control of claim 18, 19 or 20 in which bias means connected to said handle biases said push plate towards engagement with said end of said rod.

22. The chair control of claim 21 in which said stem includes a screw threaded laterally therethrough for pushing against said height adjustment actuator whereby one can adjust the action of said arm against the height adjustment actuator by threading said screw upwardly or downwardly in said stem.

23. The chair control of claim 18 in which said handle is pivotally mounted to said chair control about a pivot axis which extends generally longitudinally with respect to the fore and aft direction of said chair control; said push plate projecting upwardly from said handle whereby as one pushes said handle upwardly towards the bottom of a chair seated mounted on said chair control, said push plate is rotated inwardly towards the center of said chair control, thereby pushing said push rod inwardly.

24. The chair control of claim 23 in which said chair control includes a downwardly projecting stop flange which extends into the path of rotation of said push plate on the opposite side of said push plate from said rod whereby said stop flange limits rotation of said push plate and said handle away from the center of said chair control.

25. The chair control of claim 24 in which said chair control includes a pair of spaced, downwardly projecting ears, a pivot axle extending between said ears, said handle being pivotally mounted on said pivot axle.

26. The chair control of claim 25 in which said bias means comprises a spring having a looped portion looped around said pivot axle and having a hooked end hooked underneath a portion of said handle and another hooked end hooked behind one of said downwardly projecting ears whereby said handle is biased upwardly against the end of said push rod.

* * * * *

UNITED STATES PATENT AND TRADEMARK OFFICE

CERTIFICATE OF CORRECTION

PATENT NO. : 4,373,692

DATED : February 15, 1983

INVENTOR(S) : Knoblauch, et al.

It is certified that error appears in the above-identified patent and that said Letters Patent is hereby corrected as shown below:

Column 2, line 47:
"16" should be --8--

Column 4, line 65:
"axel" should be --axle--

Column 5, line 6:
"20" should be --12--

Column 5, line 60:
"snuggly" should be --snugly--

Column 6, line 6:
"snuggly" should be --snugly--

Column 9, line 16:
"seated" should be --seat--

Signed and Sealed this

*Thirteenth* Day of *September 1983*

[SEAL]

*Attest:*

GERALD J. MOSSINGHOFF

*Attesting Officer*

*Commissioner of Patents and Trademarks*